US006332344B1

(12) United States Patent
Montoya

(10) Patent No.: US 6,332,344 B1
(45) Date of Patent: Dec. 25, 2001

(54) DEADBOLT SECURITY CHAIN

(76) Inventor: Mike Montoya, 4327 E. Beck Ln., Phoenix, AZ (US) 85032

( * ) Notice: Subject to any disclaimer, the term of this patent is extended or adjusted under 35 U.S.C. 154(b) by 0 days.

(21) Appl. No.: 09/461,230

(22) Filed: Dec. 16, 1999

(51) Int. Cl.[7] ..... E05B 13/00

(52) U.S. Cl. ..... 70/211; 70/93; 70/416; 70/429; 292/264

(58) Field of Search ..... 70/416, 93, 211, 70/429, 430; 292/246, 264, 258, 288

(56) References Cited

U.S. PATENT DOCUMENTS

| | | | | |
|---|---|---|---|---|
| 1,074,359 | * | 9/1913 | Heimbaugh . | |
| 1,700,135 | * | 1/1929 | Lanes | 70/416 |
| 1,715,295 | | 5/1929 | Kaden . | |
| 2,798,753 | * | 7/1957 | Wade | 70/416 |
| 2,935,864 | | 5/1960 | Golden | 70/93 |
| 2,970,465 | | 2/1961 | Falk, Jr. et al. | 70/93 |
| 3,263,462 | * | 8/1966 | Suroff et al. | 70/416 |
| 3,414,306 | * | 12/1968 | Bernstein | 70/416 |
| 3,423,974 | * | 1/1969 | Bernsley | 70/416 |
| 3,451,708 | * | 6/1969 | Brooks . | |
| 3,853,343 | * | 12/1974 | Hunter | 292/264 |
| 4,106,800 | | 8/1978 | Nakanishi | 292/264 |
| 4,827,745 | * | 5/1989 | Baugh | 70/416 |
| 5,193,373 | * | 3/1993 | Hunt | 70/416 |
| 5,327,632 | * | 7/1994 | Moore | 70/416 X |
| 5,465,595 | * | 11/1995 | Sheppard | 70/416 |
| 5,651,279 | * | 7/1997 | Berton et al. | 70/416 X |
| 5,950,465 | * | 9/1999 | Schultz et al. | 70/416 |
| 6,182,485 | * | 2/2001 | Moore | 70/416 |

FOREIGN PATENT DOCUMENTS

| | | | | |
|---|---|---|---|---|
| 338136 | * | 6/1921 | (DE) | 70/93 |
| 916488 | * | 8/1946 | (FR) | 292/264 |
| 154980 | * | 12/1920 | (GB) | 70/416 |
| 351049 | * | 6/1931 | (GB) | 70/416 |
| 2130634 | * | 6/1984 | (GB) | 70/416 |
| 2269203 A | * | 2/1994 | (GB) | 292/264 |

* cited by examiner

*Primary Examiner*—Lloyd A. Gall
(74) *Attorney, Agent, or Firm*—Patent & Trademark Services; Joseph H. McGlynn

(57) ABSTRACT

A security device which is mounted on a door adjacent a deadbolt lock. The security device is a chain which will have a link with a ring at one end which is passed around the knob on the deadbolt to prevent the deadbolt knob from being turned and, therefore, opened.

3 Claims, 1 Drawing Sheet

DEADBOLT SECURITY CHAIN

BACKGROUND OF THE INVENTION

This invention relates, in general, to security chains, and, in particular, to security chains which are attached to deadbolts.

DESCRIPTION OF THE PRIOR ART

In the prior art various types of security chains have been proposed. For example, U.S. Pat. No. 2,970,465 to Falk, Jr. et al discloses a security chain which is secured on the door frame adjacent the door and which has a projection on the end of the chain which is engaged with a fastener on the door to prevent the door from being completely opened.

The patent to Golden discloses a security chain which is secured on the door frame adjacent the door and which has a projection on the end of the chain which is engaged with a dead bolt lock.

The patent to Kaden discloses a security chain which is secured on the door frame adjacent the door and which has a loop on the end of the chain which is engaged with the door knob to prevent the door from being completely opened.

The patent to Nakanishi discloses a security chain which is secured on the door frame adjacent the door and which has a loop on the end of the chain which is engaged with the knob on a dead bolt to prevent the door from being completely opened.

SUMMARY OF THE INVENTION

The present invention is directed to a security device which is mounted on a door adjacent a deadbolt lock. The security device is a chain which will have a ring at one end which is passed around the knob on the deadbolt to prevent the deadbolt knob from being turned and, therefore, opened.

It is an object of the present invention to provide a new and improved security chain for a deadbolt lock.

It is an object of the present invention to provide a new and improved security chain for a deadbolt lock which can be installed on any door.

It is an object of the present invention to provide a new and improved security chain for a deadbolt lock which will prevent the deadbolt lock from being operated.

These and other objects and advantages of the present invention will be fully apparent from the following description, when taken in connection with the annexed drawings.

DESCRIPTION OF THE PREFERRED EMBODIMENT

Figure 1:
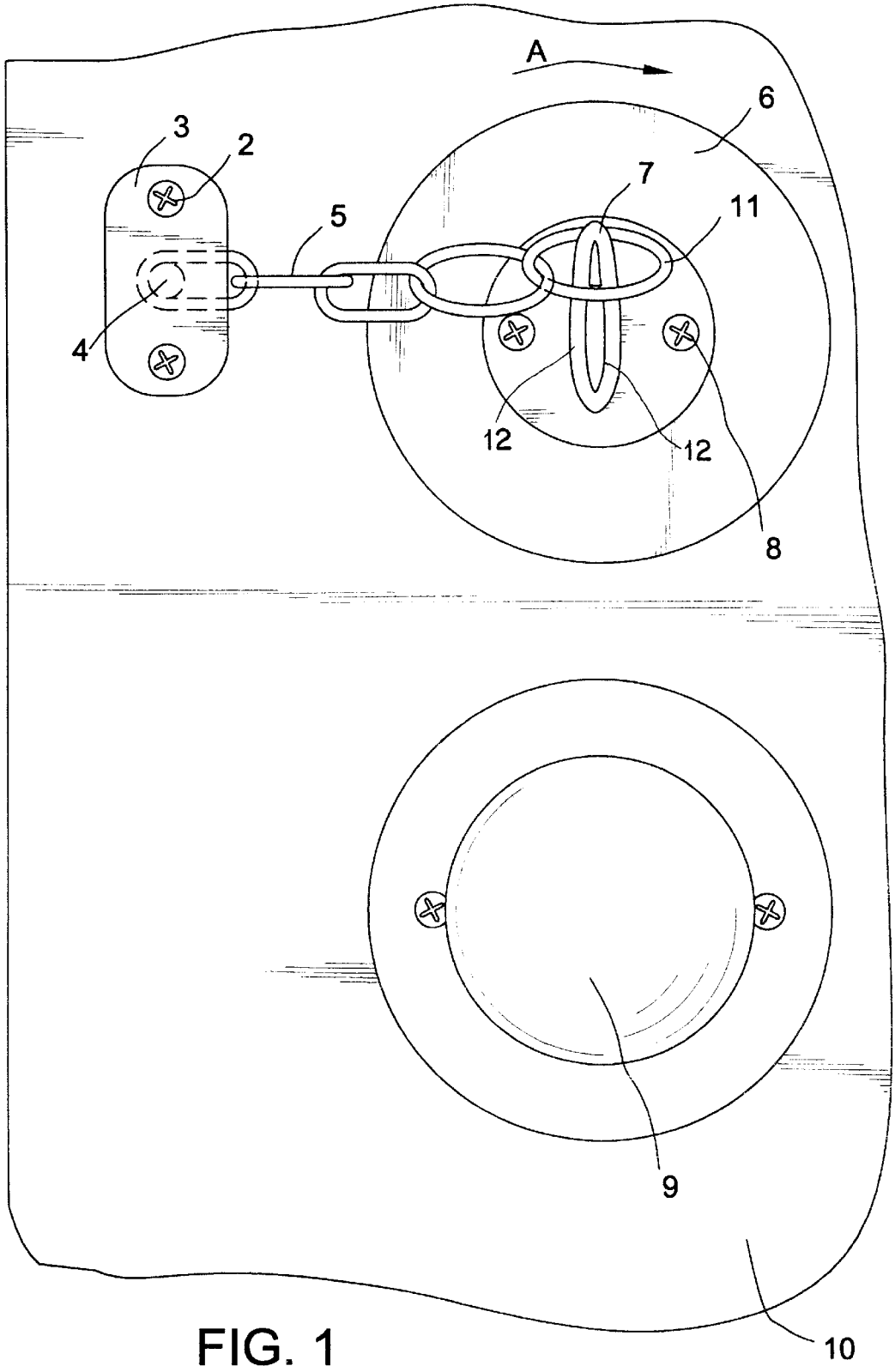
FIG. 1 is a plan view of the present invention shown mounted on a door.

Referring now to the drawings in greater detail, FIG. 1 shows the present invention mounted on a door 10. It should be noted that the type of door (i.e. metal, wood, etc) is not material, and the present invention can be used with any type of door. The security chain of the present invention is used in conjunction with any conventional deadbolt security lock 6, 7, 8, and therefore, the details of the deadbolt security lock are not necessary and will not be provided.

Most deadbolt security locks have a mounting plate 6 which contains the locking mechanism such as the turn knob 7 and mounting screws 8, which will secure the deadbolt security lock to the door 10, all of which are conventional in the art. When the turn knob 7, which includes apposed surfaces 2, is in the position shown in FIG. 1, the locking bolt (not shown) will be engaged with the striker plate (not shown) attached to the door jamb. In this position, the door can not be opened even if the conventional lock (not shown) associated with the door knob 9 is open or unlatched.

In order to open the door 10, a person would have to open the lock associated with the knob 9, and then open the deadbolt lock from the outside of the door with the appropriate key or keys. The knob 7 operates the deadbolt lock from the inside of the door by turning the knob in the direction of the arrow A to the unlock position.

The present invention is designed to prevent the deadbolt knob from being turned to the unlock position (i.e. the direction shown by the arrow A in FIG. 1), even if a person has the proper key to operate the deadbolt from the outside of the door.

The security chain 5 is mounted to the door 10 by a mounting plate 3 which is secured to the door 10 by screws 2, although the plate 3 could be secured to the door 10 in any manner without departing from the scope of the present invention. The plate 3 has an anchor 4 for securing one end of the security chain 5. The other end of the security chain 5 has a ring 11 attached thereto which is passed over the deadbolt operating knob 7. In this position, the chain is of a length to prevent the deadbolt knob 7 from being turned into the unlocked position (as shown by the arrow A). Therefore, even if a person were able to operate the deadbolt lock from the outside of the door, the chain 5 would prevent the deadbolt lock from being turned into the unlock position.

Also, it should be noted that the deadbolt security chain is shown as being mounted on the door 10, however, the chain could be mounted anywhere as long as the length of the chain is such so as to prevent the deadbolt lock from being turned into the unlocked position.

Although the Deadbolt Security Chain and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A security device for preventing a deadbolt, which is attached to a door, from being turned into an unlocked position, in combination with a deadbolt, said deadbolt having a knob for turning said deadbolt from a locked position to an unlocked position, said knob having opposed surfaces, said security device comprising means for mounting said security device to a door, securing means for preventing said knob from being turned into an unlocked position, said securing means comprising a chain having a plurality of links, one of said plurality of links being at one end of said securing means, and being attached to said means for mounting said security device to a door, and another of said plurality of links being at another end of said securing means, and passing over said opposed surfaces on said knob, when said another of said plurality of links is attached to said knob on said deadbolt, said deadbolt will be prevented from being turned into an unlocked position.

2. The security device as claimed in claim 1, wherein said another of said plurality of links is circular and is the only portion of said securing means which is connected to said knob.

3. The security device as claimed in claim 1, wherein said securing means has a length, and said opposed surfaces of said knob are positioned a second length away from said means for mounting said security device to a door when said knob is in the locked position, said opposed surfaces of said knob are positioned a third length away from said means for mounting said security device to a door when said knob is in the unlocked position, and said length of said securing means is shorter than said third length.

* * * * *